US007417603B2

(12) United States Patent
Kim et al.

(10) Patent No.: US 7,417,603 B2
(45) Date of Patent: Aug. 26, 2008

(54) PLASMA DISPLAY PANEL DRIVING DEVICE AND METHOD

(75) Inventors: Jin-Sung Kim, Suwon-si (KR); Woo-Joon Chung, Suwon-si (KR); Seung-Hun Chae, Suwon-si (KR); Jin-Ho Yang, Suwon-si (KR); Tae-Seong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 568 days.

(21) Appl. No.: 11/077,184

(22) Filed: Mar. 9, 2005

(65) Prior Publication Data

US 2005/0219153 A1 Oct. 6, 2005

(30) Foreign Application Priority Data

Mar. 19, 2004 (KR) ..... 10-2004-0018814

(51) Int. Cl.
*G09G 3/28* (2006.01)

(52) U.S. Cl. ..... 345/60; 345/62; 345/67; 345/68

(58) Field of Classification Search ..... 345/60–100, 345/204–214; 315/169.1–169.4
See application file for complete search history.

(56) References Cited

U.S. PATENT DOCUMENTS 6,111,556 A * 8/2000 Moon ..... 345/60
6,567,059 B1 * 5/2003 Ide et al. ..... 345/60
6,816,136 B2 * 11/2004 Tanaka et al. ..... 345/66
2004/0164929 A1 * 8/2004 Ide et al. ..... 345/60

FOREIGN PATENT DOCUMENTS

| | | |
|---|---|---|
| JP | 2001-93427 | 4/2001 |
| JP | 2002-156943 | 5/2002 |
| JP | 2002-258795 | 9/2002 |
| KR | 2002-0088176 | 11/2002 |

OTHER PUBLICATIONS

Korean Patent Abstracts for Publication No. 1020020088176, Date of publication of application Nov. 27, 2002, in the name of G. Chae et al.
Patent Abstracts of Japan, Publication No. 2001-093427, dated Apr. 6, 2001, in the name of Koichi Wani et al.
Patent Abstracts of Japan, Publication No. 2002-156943, dated May 31, 2002, in the name of Dae Jin Myoung et al.
Patent Abstracts of Japan, Publication No. 2002-258795, dated Sep. 11, 2002, in the name of Hajime Honma et al.

* cited by examiner

*Primary Examiner*—David L Lewis
(74) *Attorney, Agent, or Firm*—Christie, Parker & Hale, LLP

(57) ABSTRACT

A method for driving a plasma display panel having first electrodes, second electrodes, and panel capacitors formed between the first and second electrodes. In a reset period: a first voltage corresponding to a voltage applied to the first electrode which is not selected in an address period is applied; a waveform which rises to a second voltage from the first voltage is applied to the first electrode; and the voltage at the first electrode is reduced to a third voltage.

12 Claims, 12 Drawing Sheets

PLASMA DISPLAY PANEL DRIVING DEVICE AND METHOD

CROSS REFERENCE TO RELATED APPLICATION

This application claims priority to and the benefit of Korean Patent Application No. 10-2004-0018814, filed on Mar. 19, 2004, which is incorporated by reference herein.

BACKGROUND OF THE INVENTION

1. Field of the Invention

The present invention relates to a plasma display panel (PDP) driver and a driving method thereof.

2. Discussion of the Related Art

Recently, liquid crystal displays (LCDs), field emission displays (FEDs), and plasma displays have been actively developed. Plasma displays have better luminance and light emission efficiency as compared to other types of flat panel devices, and they also have wider view angles. Therefore, the plasma displays have come into the spotlight as substitutes for the conventional cathode ray tubes (CRTs) in large displays of greater than 40 inches.

The plasma display is a flat display that uses plasma generated by a gas discharge process to display characters or images, and tens to millions of pixels are provided thereon in a matrix format, depending on its size. Plasma displays are categorized into DC plasma displays and AC plasma displays, according to supplied driving voltage waveforms and discharge cell structures.

Since the DC plasma displays have electrodes exposed in the discharge space, they allow a current to flow in the discharge space while the voltage is supplied, and therefore they problematically require resistors for current restriction. On the other hand, since the AC plasma displays have electrodes covered by a dielectric layer, capacitances are naturally formed to restrict the current, and the electrodes are protected from ion shocks in the case of discharging. Accordingly, they have a longer lifespan than the DC plasma displays.

FIG. 1 shows a perspective view of an AC PDP. As shown, a scan electrode 4 and a sustain electrode 5, disposed over a dielectric layer 2 and a protection film 3, are provided in parallel and form a pair with each other under a first glass substrate 1. A plurality of address electrodes 8 covered with an insulation layer 7 are installed on a second glass substrate 6. Barrier ribs 9 are formed in parallel with the address electrodes 8, on the insulation layer 7 between the address electrodes 8, and phosphor 10 is formed on the surface of the insulation layer 7 between the barrier ribs 9. The first and second glass substrates 1, 6 having a discharge space 11 between them are provided facing each other so that the scan electrode 4 and the sustain electrode 5 may respectively cross the address electrode 8. The address electrode 8 and a discharge space 11 formed at a crossing point of the scan electrode 4 and the sustain electrode 5 form a discharge cell 12.

FIG. 2 shows a typical PDP electrode arrangement diagram. As shown, the PDP electrode has an m×n matrix configuration. It has address electrodes A1 to Am in a column direction, and scan electrodes Y1 to Yn and sustain electrodes X1 to Xn in a row direction, alternately. The scan electrodes will be referred to as Y electrodes and the sustain electrodes as X electrodes hereinafter. The discharge cell 12 shown in FIG. 2 corresponds to the discharge cell 12 shown in FIG. 1.

Typically, the AC PDP driving method includes a reset period, an addressing period, and a sustain period according to temporally varied operations. In the reset period wall charges caused by a previous sustain discharge are erased and the cells are reset in order to stably perform a next address operation. In the address period, the cells that are turned on and the cells that are not turned on are selected on the panel, and wall charges are accumulated on the cells that are turned on (i.e., the addressed cells). In the sustain period, a discharge for actually displaying pictures on the addressed cells is performed by alternately applying a sustain discharge pulse of Vs to the scan and sustain electrodes.

FIG. 3 shows a conventional PDP Y electrode driver 320 circuit diagram. As shown, the Y electrode driver 320 includes a reset driver 321, a scan driver 322, and a sustain driver 323.

The reset driver 321 includes a rising ramp switch Yrr for generating a rising reset waveform, a falling ramp switch Yrr for generating a falling ramp waveform in a reset period, a power source Vset, a capacitor Cset operable as a floating power source, and a switch Ypp.

The scan driver 322 generates a scan pulse in the address period, and includes a power source VscH for supplying a voltage to a scan electrode which is not selected, a capacitor Csc for storing the voltage VscH, and a plurality of scan driver ICs coupled to the Y electrodes. The scan driver IC includes a switch YscH for supplying the high voltage VscH to the panel capacitor Cp, and a switch YscL for supplying a low voltage 0V.

The sustain driver 323 generates a sustain discharge pulse in the sustain period, and includes switches Ys, Yg coupled between the power source Vs and the ground GND.

In the prior art, when a reset waveform is applied to the Y electrode in the reset period, the switch Ypp is turned off to prevent applying a voltage which is higher than the sustain discharge voltage Vs applied to the sustain driver 323, and the current path coupled to the Y electrode from the capacitor Cset allows a voltage to be applied which is higher than the voltage Vs to the Y electrode through the capacitor Cset and the switch Yrr.

The maximum voltage of a circuit is determined by the maximum voltage applied in the reset period, typically ranging from 300 to 500V. Therefore, when the above-noted large withstanding voltage is applied to the sustain driver 323, the withstanding voltages of elements of the sustain driver 323 are increased, and hence, a switch Ypp is needed between the capacitor Cset and the switch Yrr, as shown FIG. 3, in order to prevent the increase of the withstanding voltages.

However, since the switch Ypp must withstand the large amount of current at the time of a sustain discharge and the high voltages which are applied in the reset period, it is required to use expensive elements with high withstanding voltages. Also, since the switch Ypp is coupled to a main path from which the sustain discharge waveform is output, voltages may be dropped or waveforms may be distorted when the currents flow.

SUMMARY OF THE INVENTION

The present invention provides a method for a PDP driving device and a method for applying a reset waveform without a switch on a main path thereof.

In one aspect of the present invention, a method for driving a plasma display panel having first electrodes, second electrodes, and panel capacitors formed between the first and second electrodes is provided. In a reset period, (a) a first voltage corresponding to a voltage applied to the first electrode which is not selected in an address period is applied; (b) a waveform which gradually rises to a second voltage from the first voltage is applied to the first electrode; and (c) the voltage at the first electrode is reduced to a third voltage.

The third voltage corresponds to the first voltage. The third voltage corresponds to a sustain voltage applied to the first electrode, the sustain voltage being for a sustain discharge. The second voltage is higher than or equal to a sum of the sustain voltage and the first voltage.

In another aspect of the present invention, a PDP driver for applying voltages to a plurality of first electrodes, a plurality of second electrodes, and a plurality of panel capacitors formed by the first and second electrodes, includes a first transistor and a plurality of selecting circuits. The first transistor is coupled between a first power source for supplying a first voltage and the first electrode. The selecting circuits are coupled to both terminals of a capacitor charged with a second voltage and are operable to sequentially apply a scan voltage of the first electrodes in an address period. In a reset period, the second voltage is applied to the first electrode through the selecting circuit, and the first transistor is turned on to apply a waveform which gradually rises to a third voltage to the first electrode through the selecting circuit, the third voltage being higher than the second voltage by as much as the first voltage.

The first voltage is less than or equal to a voltage applied to the first electrode for the purpose of a sustain discharge.

The selecting circuit includes a second transistor and a third transistor. The second transistor has a first terminal coupled to the first electrode and a second terminal coupled to a first terminal of the capacitor. The third transistor has a first terminal coupled to the first electrode and a second terminal coupled to a second terminal of the capacitor.

When the first transistor is turned on, the second transistor is turned on to apply a waveform which gradually rises to a third voltage to the first electrode, the third voltage being higher than the second voltage by as much as the first voltage.

The first transistor is turned off to reduce the voltage at the first electrode to the second voltage after a rising waveform is applied to the first electrode.

The PDP driver further includes a fourth transistor coupled between a second power source for applying a fourth voltage applied to the first electrode for the purpose of the sustain discharge and the first electrode.

The first and second transistors are turned off and the third and fourth transistors are turned on to reduce the voltage at the first electrode to the fourth voltage after a rising waveform is applied to the first electrode.

DETAILED DESCRIPTION

Figure 1:
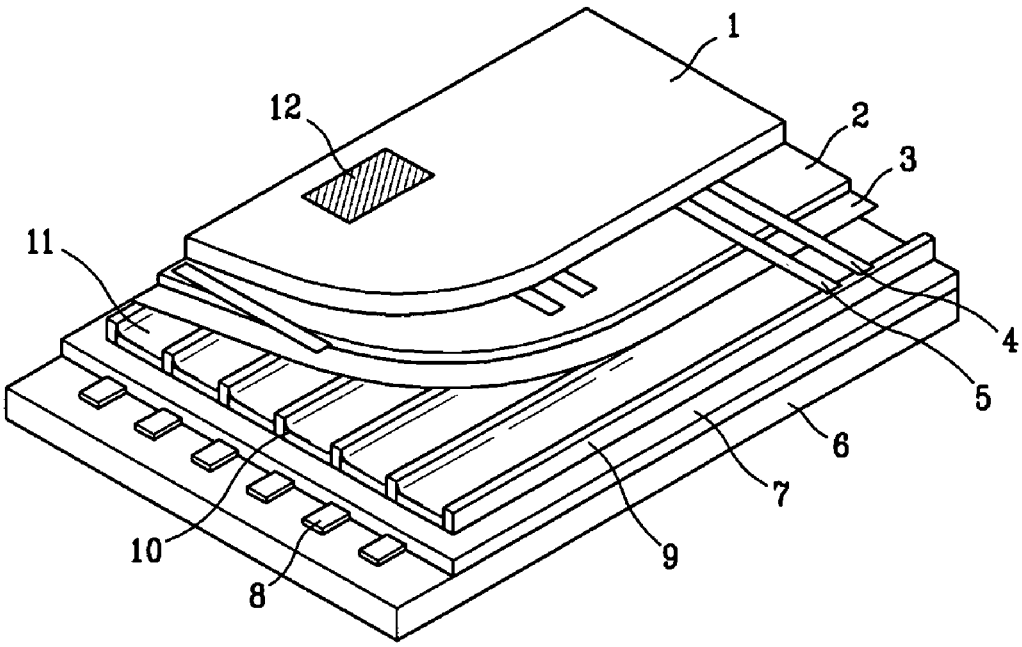
FIG. 1 (Prior Art)
FIG. 1 shows a partial perspective view of an AC PDP.
Figure 2:
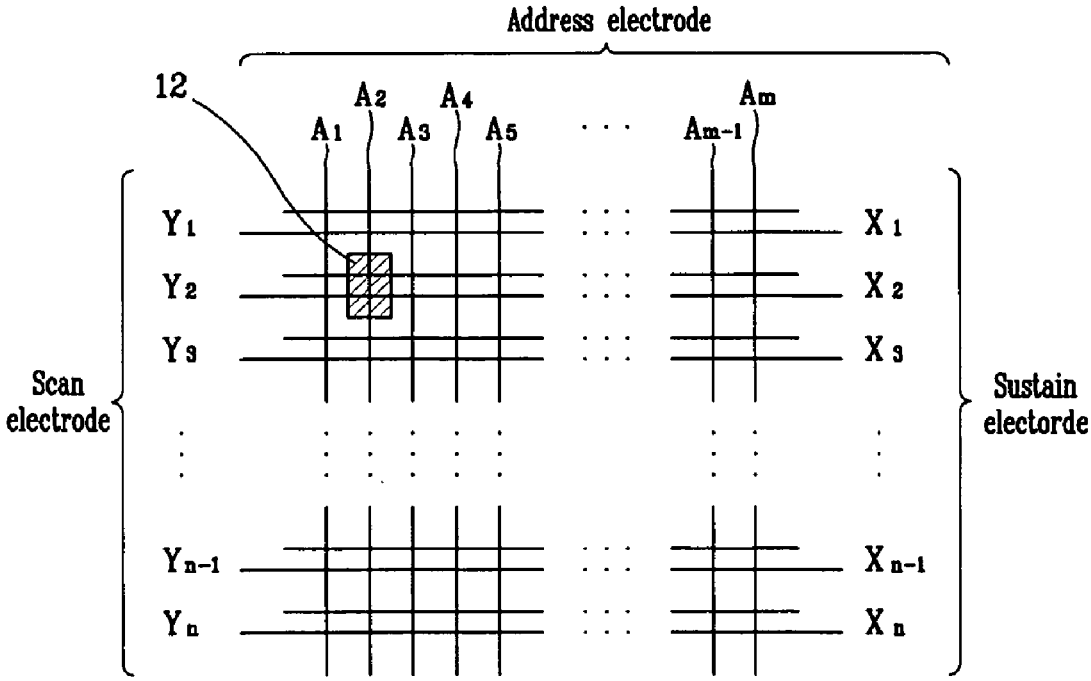
FIG. 2 (Prior Art)
FIG. 2 shows a PDP electrode arrangement diagram.
Figure 3:
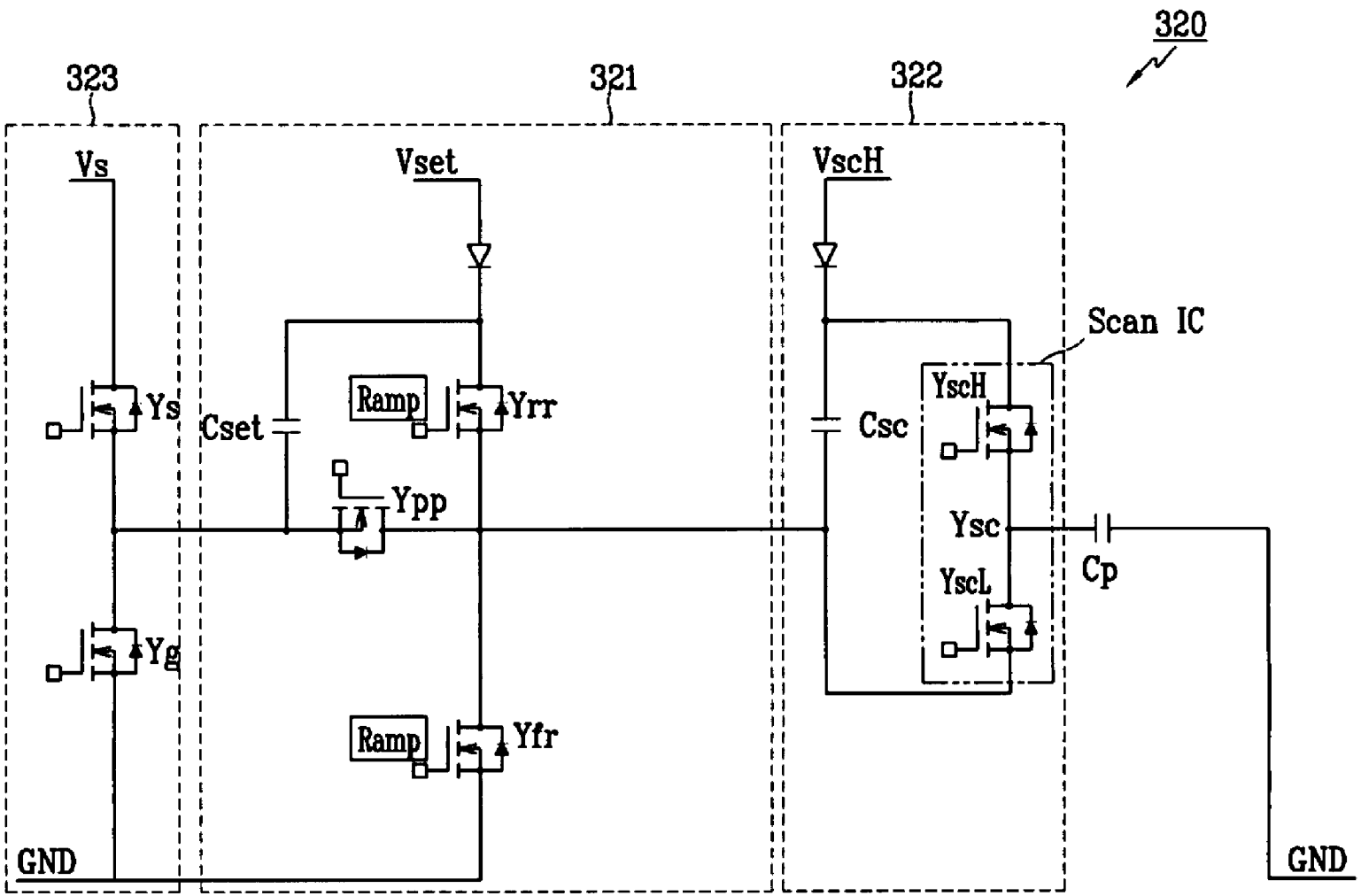
FIG. 3(Prior Art)
FIG. 3 shows a conventional PDP Y electrode driving circuit diagram.
Figure 4:
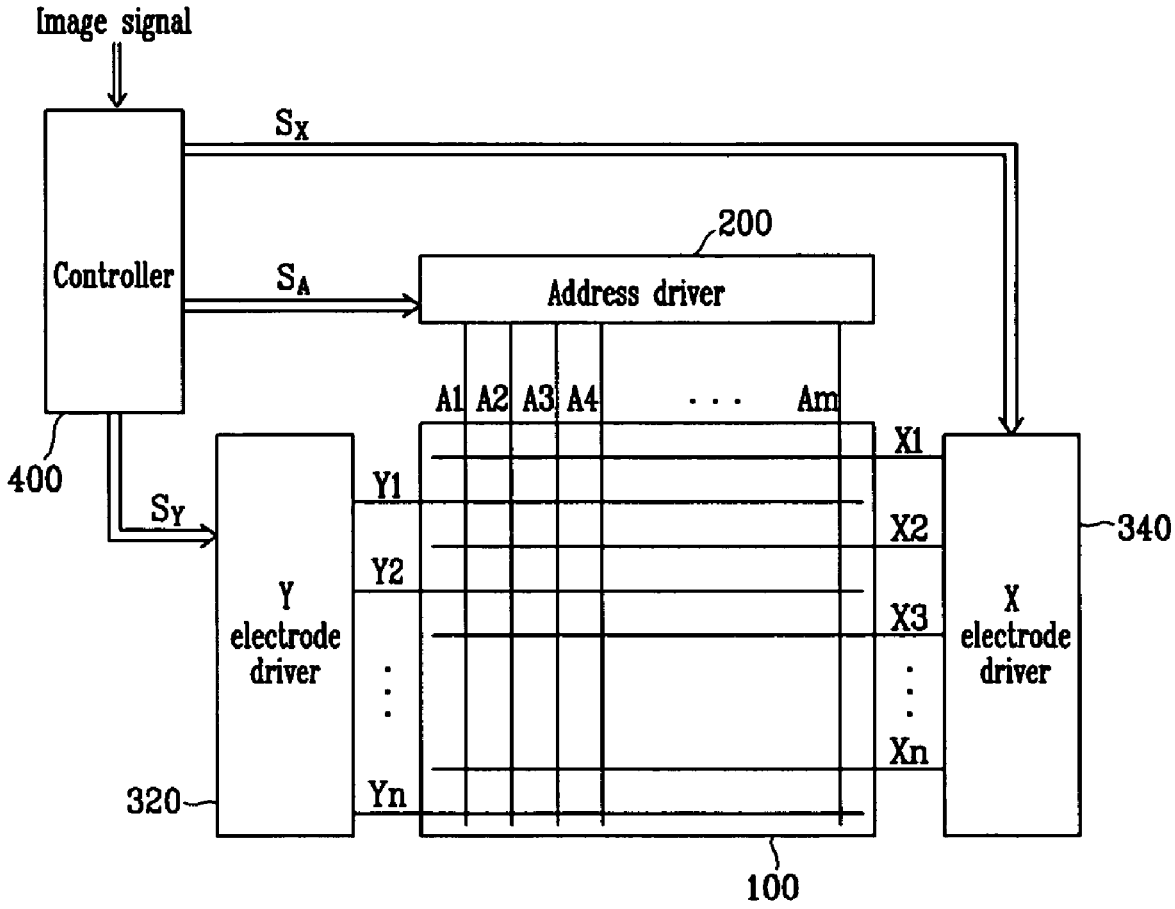
FIG. 4 shows a PDP according to an exemplary embodiment of the present invention.

Referring now to FIG. 4, a PDP according to an exemplary embodiment of the present invention includes a plasma panel 100, an address driver 200, a Y electrode driver 320, an X electrode driver 340, and a controller 400.

The plasma panel 100 includes a plurality of address electrodes A1 to Am arranged in a column direction, and a plurality of first electrodes Y1 to Yn (referred to as Y electrodes hereinafter) and second electrodes X1 to Xn (referred to as X electrodes hereinafter) arranged in a row direction.

The address driver 200 receives an address driving control signal SA from the controller 400, and applies a display data signal for selecting a discharge cell to be displayed to each address electrode.

The Y electrode driver 320 and the X electrode driver 340 receive a Y electrode driving signal $S_y$ and an X electrode driving signal $S_x$ from the controller 400 respectively, and apply them to the X electrode and the Y electrode.

The controller 400 receives an external image signal, generates an address driving control signal $S_A$, a Y electrode driving signal $S_Y$, and an X electrode driving signal $S_X$, and transmits them to the address driver 200, the Y electrode driver 320, and the X electrode driver 340, respectively.

Figure 5:
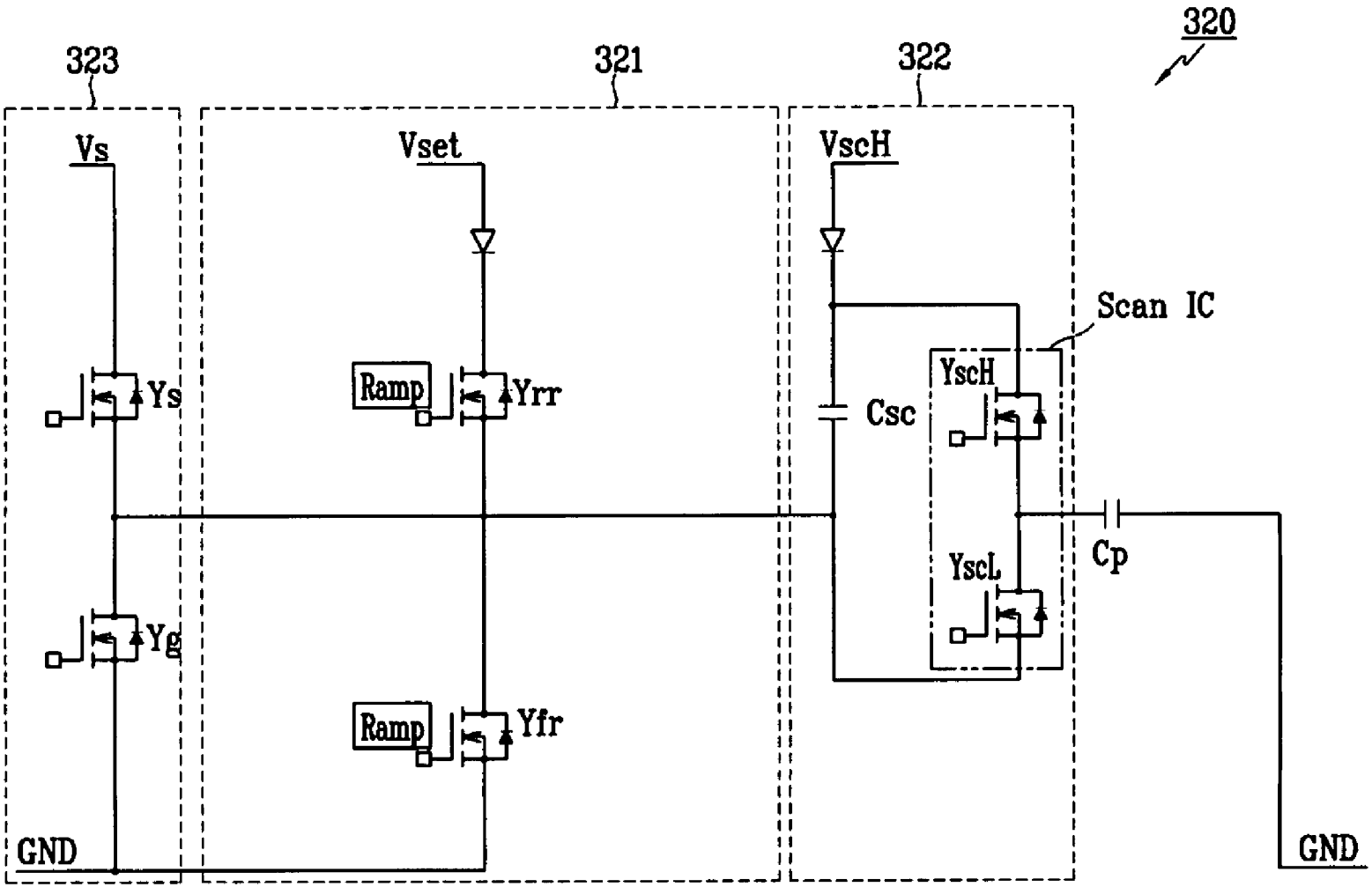
FIG. 5 shows a detailed circuit diagram of a Y electrode driver according to a first exemplary embodiment of the present invention.

FIG. 5 shows the PDP Y electrode driver 320 diagram according to the first exemplary embodiment of the present invention. The Y electrode driver 320 includes a reset driver 321, a scan driver 322, and a sustain driver 323.

The reset driver 321 includes a rising ramp switch Yrr being coupled to a power source Vset and applying a rising reset waveform to the Y electrode, and a falling ramp switch Yfr being coupled to a ground GND and applying a gradually falling waveform to the Y electrode.

The scan driver 322 generates a scan pulse in the address period, and includes a power source VscH for supplying a voltage to a scan electrode which is not selected, a capacitor Csc for storing the voltage VscH, and a scan driver IC. The scan driver IC includes a switch YscH for supplying the high voltage VscH to the panel capacitor Cp, and a switch YscL for supplying a low voltage 0V thereto.

The sustain driver 323 generates a sustain discharge pulse in the sustain period, and includes switches Ys and Yg coupled between the power source Vs and the ground GND.

In this instance, the panel capacitor Cp equivalently illustrates a capacitance component between the X electrode and the Y electrode. Also, for ease of description, the X electrode of the capacitor Cp is depicted to be coupled to the ground terminal, but the X electrode is actually coupled to the X electrode driver 340.

Figure 6:
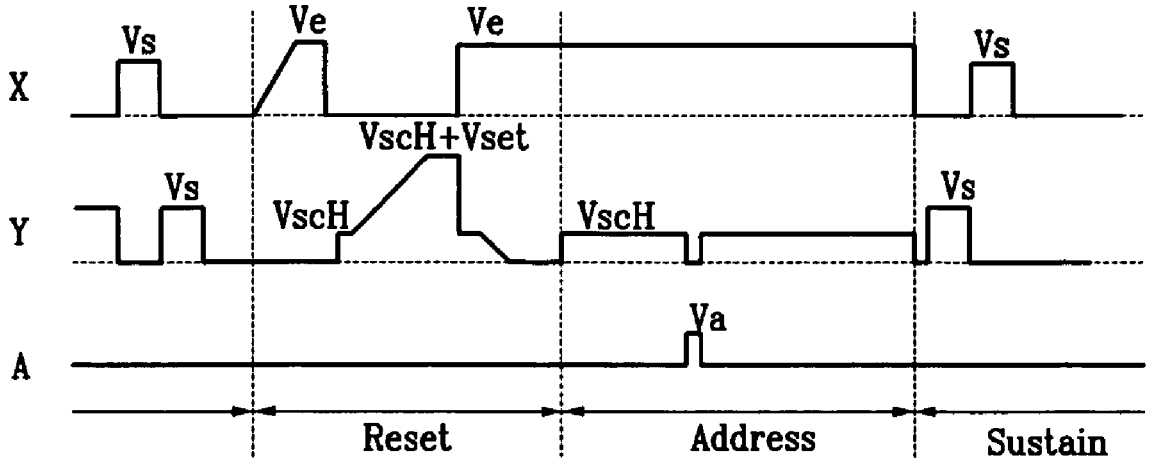
FIG. 6 shows a driving waveform diagram according to a first exemplary embodiment of the present invention.

The process for the Y electrode driver 320 to apply a reset pulse to the panel capacitor Cp will now be described with reference to FIGS. 6 and 7. FIG. 6 shows a driving waveform diagram according to a first exemplary embodiment of the present invention, and FIG. 7 shows a current path when a reset waveform is applied to the Y electrode of a panel capacitor Cp in a reset period of the Y electrode driver 320 according to the first exemplary embodiment of the present invention.

Figure 7:
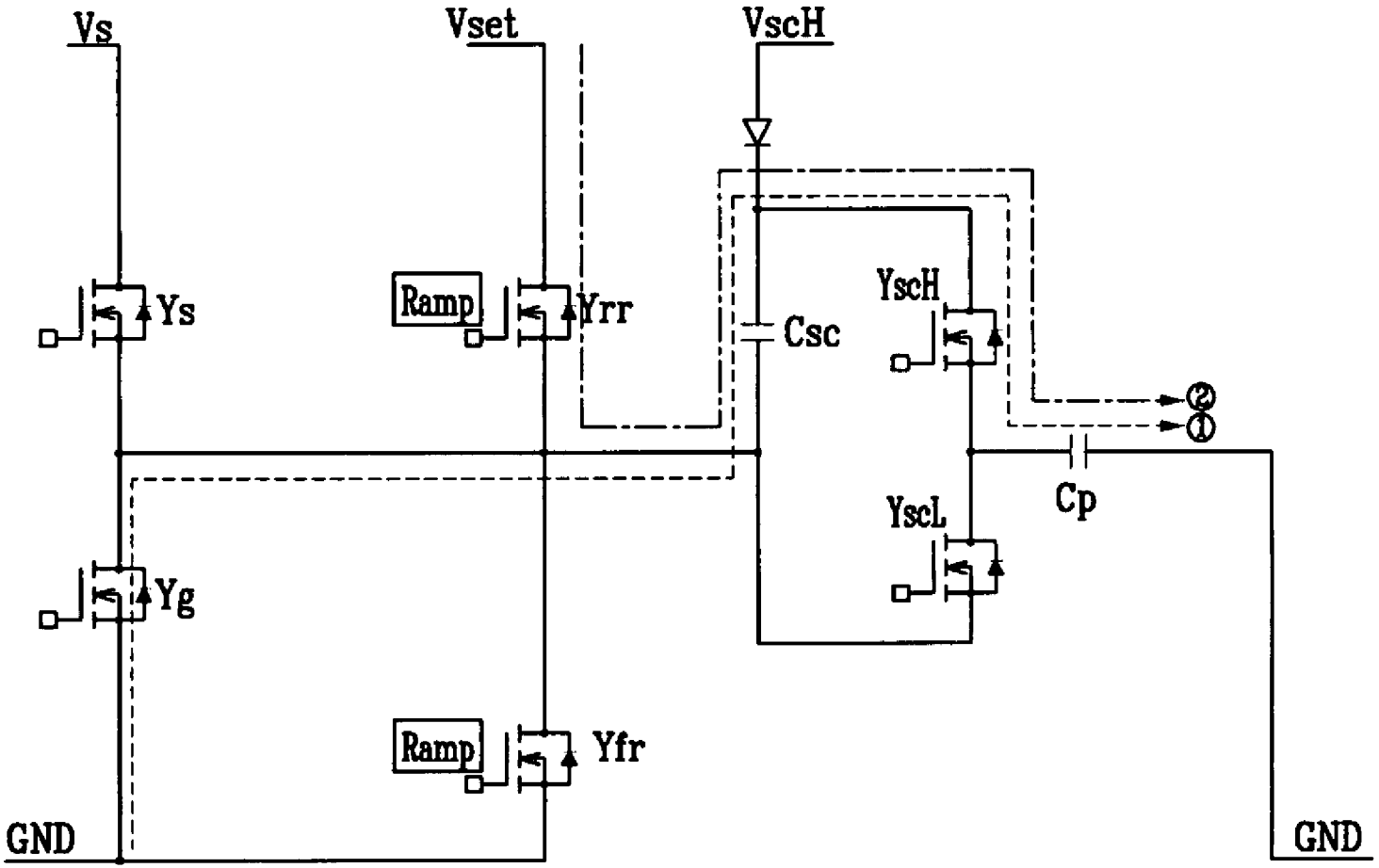
FIG. 7 shows a current path when a reset waveform is applied to the Y electrode of a panel capacitor in a reset period of the Y electrode driver according to a first exemplary embodiment of the present invention.

As shown in FIG. 7, the high-side switch YscH of the scan IC is turned on in the earlier stage of the Y ramp rising period while the switch Ys is turned off and the switch Yg is turned on. In this instance, the voltage VscH is applied to the Y electrode of the capacitor Cp through the switch YscH since the capacitor Csc is charged with the voltage VscH (Refer to FIG. 6 and Path ① of FIG. 7.)

When the switch Yg is turned off and the switch Yrr is turned on while the switch YscH is turned on, a voltage which gradually rises to the voltage Vset is supplied through the switch Yrr, and hence, a voltage which gradually rises to the voltage (VscH+Vset) from the voltage VscH is applied to the Y electrode through the high-side switch YscH of the scan IC (refer to FIG. 6 and Path ② of FIG. 7.)

The switch Yrr is turned off and the switch Yg is turned on to reduce the voltage at the Y electrode to the voltage VscH through Path ① of FIG. 7 before a falling reset waveform is applied to the Y electrode.

When the switch Yg and the switch YscH are turned off and the switch Yfr and the switch YscL are turned on, a falling ramp waveform which gradually falls to the voltage 0V from the voltage VscH is applied to the Y electrode through a path formed in the order of the panel capacitor Cp, the switch YscL, the capacitor Csc, the switch Yfr, and the ground terminal GND.

The voltage at the Y electrode has been reduced to the voltage VscH from the voltage (VscH+Vset) and the falling ramp waveform has been applied to the Y electrode in the first embodiment. However, differing from this, a falling ramp start voltage can be reduced to the voltage Vs.

Figure 8:
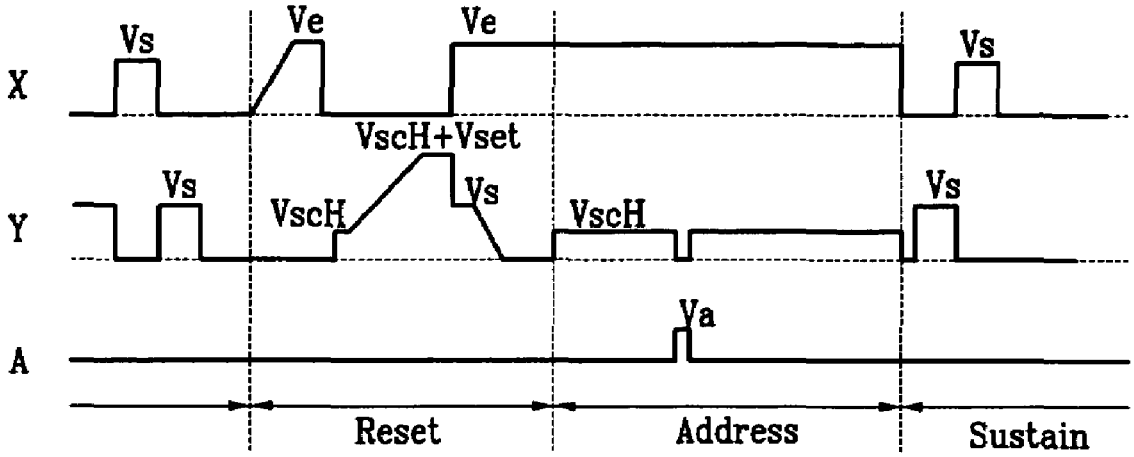
FIG. 8 shows a driving waveform diagram according to a second exemplary embodiment of the present invention.

FIG. 8 shows a driving waveform diagram according to a second exemplary embodiment of the present invention. The switches Yrr and YscH are turned off and the switches Ys and YscL are turned on to reduce the voltage at the Y electrode to the voltage Vs before a falling reset waveform is applied to the Y electrode in the second embodiment.

When the switch Ys is turned off and the switch Yfr is turned on, a falling ramp waveform which gradually falls to the voltage 0V from the voltage Vs is applied to the Y electrode through the path formed in the order of the panel capacitor Cp, the switch YscL, the switch Yfr, and the ground terminal GND.

The power source for supplying the voltage Vset has been coupled to the switch Yrr in the first and second embodiments, and in addition, a power source of Vs for applying a sustain voltage can be used.

Figure 9:
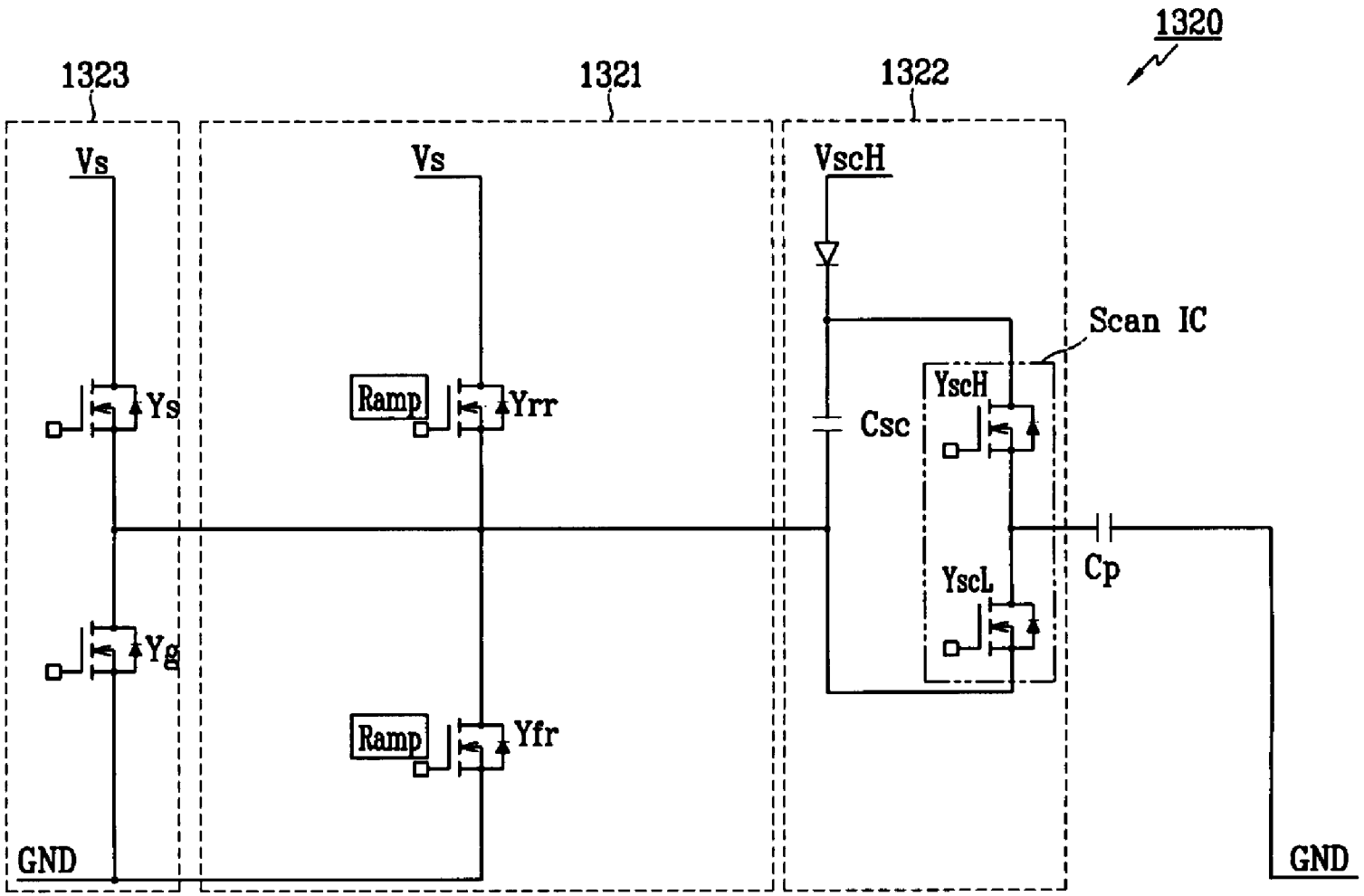
FIG. 9 shows a circuit diagram of the Y electrode driver according to a third exemplary embodiment of the present invention.
Figure 10:
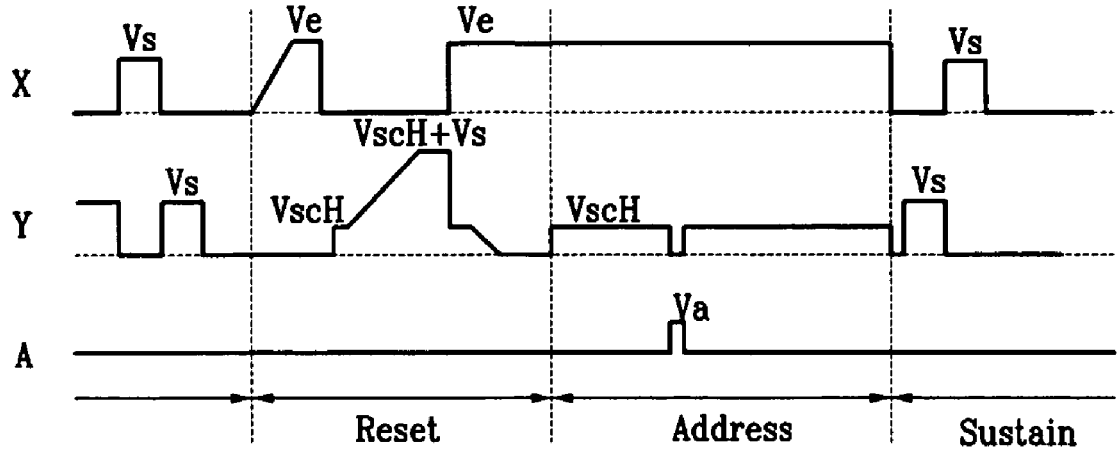
FIG. 10 shows a driving waveform diagram according to a third exemplary embodiment of the present invention.

FIG. 9 shows a circuit diagram of the Y electrode driver 1320 according to a third exemplary embodiment of the present invention, wherein Y electrode driver 1320 includes a reset driver 1321, a scan driver 1322, and a sustain driver 1323. FIG. 10 shows a driving waveform diagram according to the third exemplary embodiment of the present invention.

The method for applying the voltage VscH to the Y electrode in the earlier stage of the Y ramp rising period will not be described since it corresponds to the method of the first and second embodiments.

When the switch Yrr of reset driver 1321 is turned on while the switch YscH of scan driver 1322 is turned on, a voltage which gradually rises to the voltage Vs is applied through the switch Yrr, and hence, a voltage which gradually rises to the voltage (VscH+Vs) from the voltage VscH is applied to the Y electrode through the high-side switch YscH of the scan IC.

The switch Yrr is turned off and the switch Yg is turned on to reduce the voltage at the Y electrode to the voltage VscH before a falling reset waveform is applied to the Y electrode.

When the switch Yg of sustain driver 1323 and the switch YscH are turned off and the switch Yfr and the switch YscL are turned on, a falling ramp waveform which gradually falls to the voltage 0V from the voltage VscH is applied to the Y electrode through the path formed in the order of the panel capacitor Cp, the switch YscL, the capacitor Csc, the switch Yfr, and the ground terminal GND.

In a like manner to that of the second embodiment, the falling ramp start voltage after applying the rising ramp can be reduced to the voltage Vs in the circuit of FIG. 9.

Figure 11:
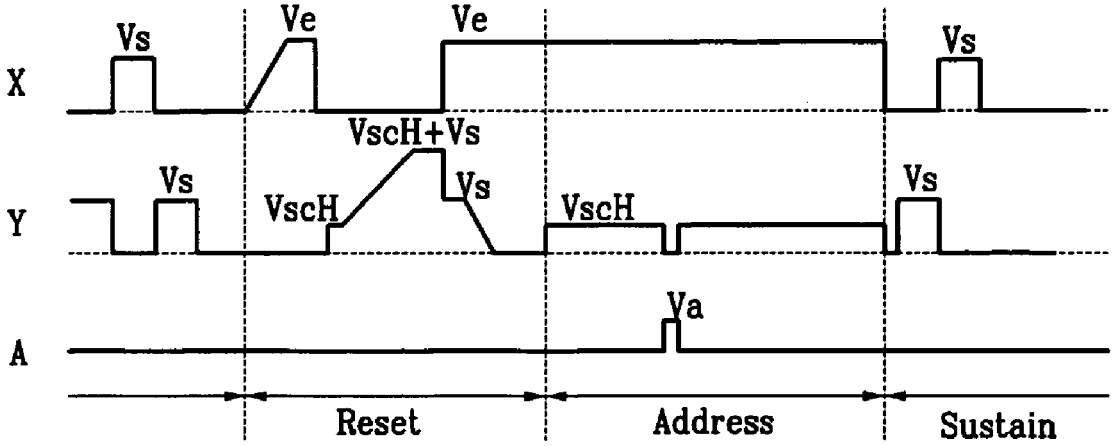
FIG. 11 shows a driving waveform diagram according to a fourth exemplary embodiment of the present invention.

FIG. 11 shows a driving waveform diagram according to a fourth exemplary embodiment of the present invention. The process for applying the falling ramp reset waveform of FIG. 11 corresponds to the process of the second embodiment, and no further description will be provided.

The number of power sources is reduced by using the power source which is the same as that of the sustain driver 323 for the power source coupled to the switch Yrr of the third and fourth embodiments.

The first to fourth embodiments have described the cases in which the final voltage of a falling reset waveform and the scan voltage applied to the selected discharge cell are 0V. However, the present invention is also applicable to the case in which the final voltage of a falling reset waveform and the scan voltage applied to the selected discharge cell are negative voltages.

In this instance, a switch Ynp is coupled between the switches Yfr and Ysc for applying negative voltages and the rising ramp switch Yrr in order to prevent the current from reversely flowing to the sustain driver when a negative voltage is applied to the Y electrode.

Figure 12:
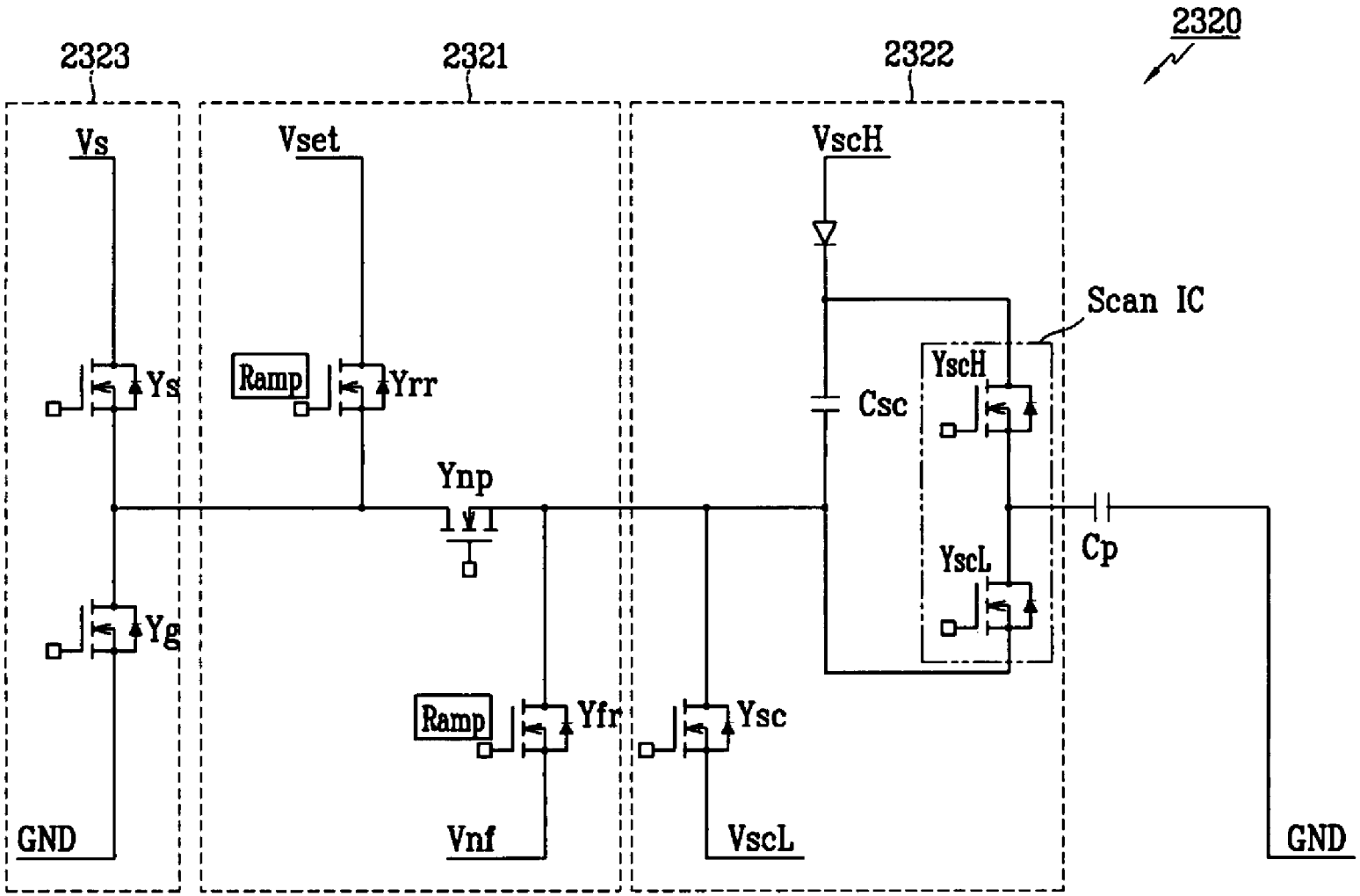
FIG. 12 shows a circuit diagram of the Y electrode driver according to a fifth exemplary embodiment of the present invention.

FIG. 12 shows a circuit diagram of the Y electrode driver 2320 according to a fifth exemplary embodiment of the present invention. The Y electrode driver 2320 includes a reset driver 2321, a scan driver 2322, and a sustain driver 2323.

The reset driver 2321 includes a rising ramp switch Yrr which is coupled to the power source Vset and applies a gradually rising waveform to the Y electrode, and a falling ramp switch Yfr which is coupled to the power source Vnf for supplying a negative voltage and applies a gradually falling waveform to the Y electrode.

The scan driver 2322 generates a scan pulse in the address period, and includes power sources VscH and VscL for supplying a voltage to a scan electrode, a switch Ysc coupled to the power source VscL, a capacitor Csc for storing the voltage (VscH−VscL), and a scan driver IC. The scan driver IC includes a switch YscH for supplying a high voltage VscH to the panel capacitor Cp, and a switch YscL for supplying a low voltage VscL.

The sustain driver 2323 generates a sustain discharge pulse in the sustain period, and includes switches Ys, Yg coupled between the power source Vs and the ground terminal GND.

Also, a switch Ynp is coupled between the switches Yfr and Ysc for supplying negative voltages and the rising ramp switch Yrr in order to prevent the current from reversely flowing to the sustain driver when the negative voltage is applied to the Y electrode as described above.

The process for the Y electrode driver 2320 to apply a reset pulse to the panel capacitor Cp according to the fifth embodiment will be described with reference to FIGS. 13 and 14.

Figure 13:
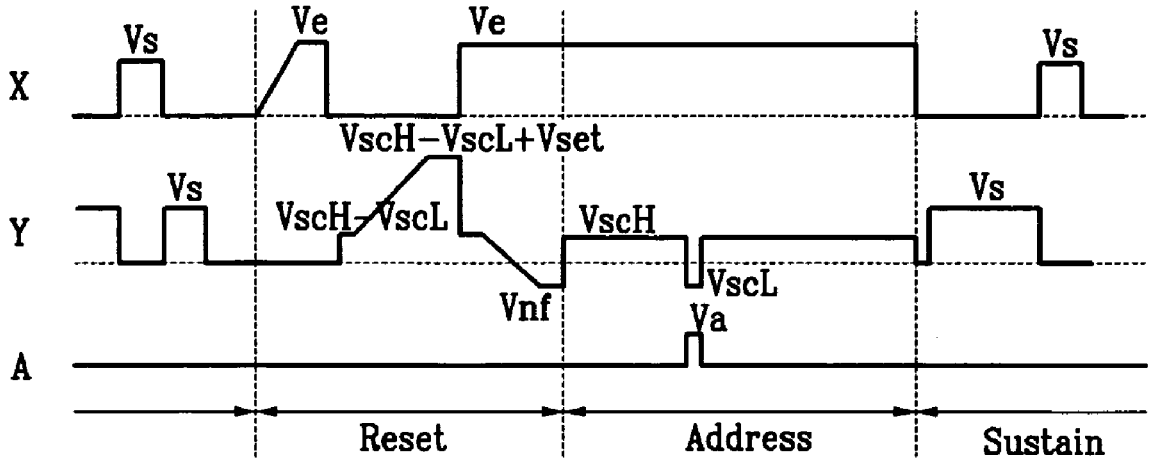
FIG. 13 shows a driving waveform diagram according to a fifth exemplary embodiment of the present invention.
Figure 14:
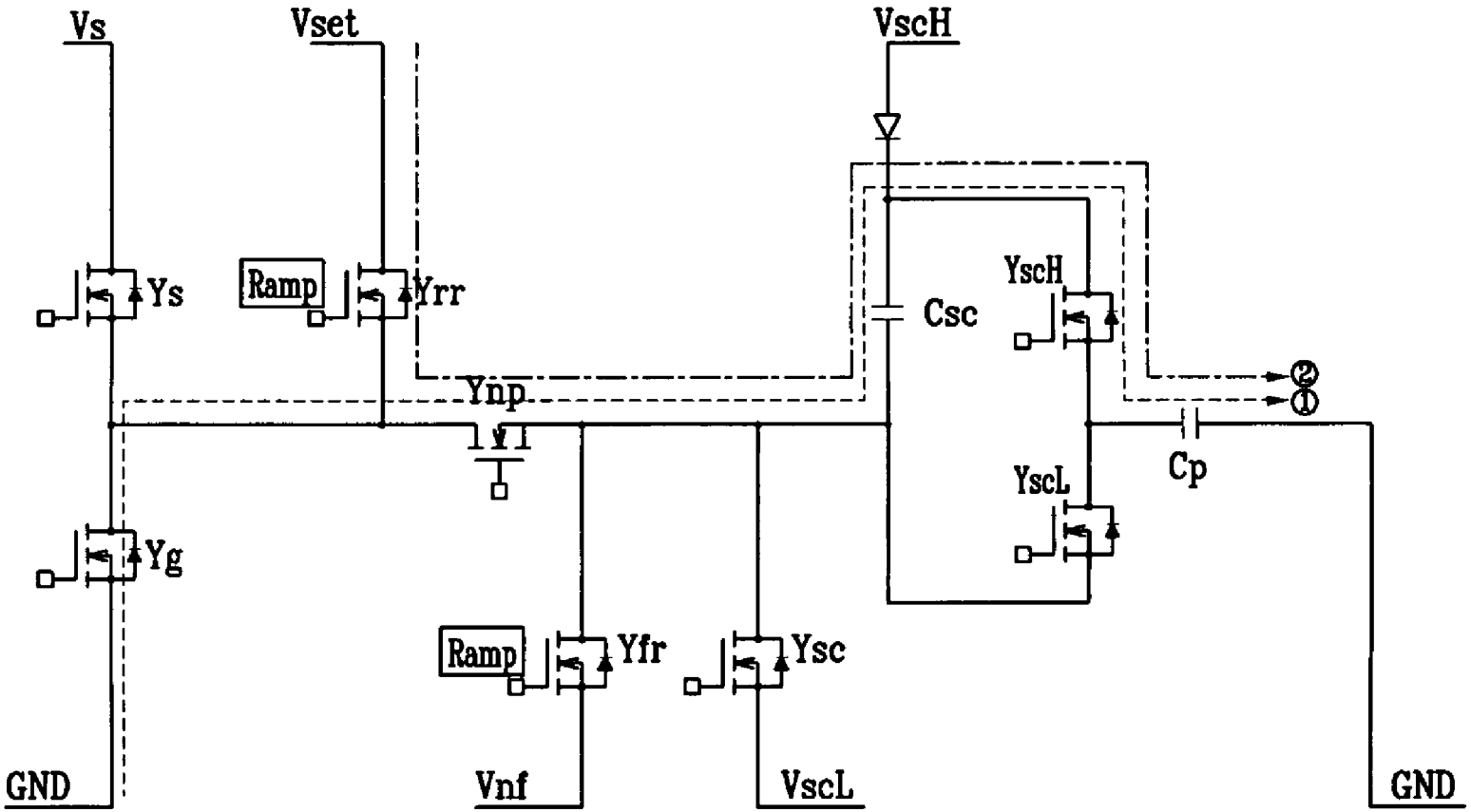
FIG. 14 shows a current path when a reset waveform is applied to the Y electrode of a panel capacitor in a reset period of the Y electrode driver according to a fifth exemplary embodiment of the present invention.

FIG. 13 shows a driving waveform diagram according to a fifth exemplary embodiment of the present invention, and FIG. 14 shows a current path when a reset waveform is applied to the Y electrode of a panel capacitor Cp in a reset period of the Y electrode driver 2320 according to a fifth exemplary embodiment of the present invention.

As shown in FIG. 13, the high-side switch YscH of the scan IC is turned on in the earlier stage of the Y ramp rising period while the switch Ys is turned off and the switch Yg is turned on. In this instance, the voltage (VscH−VscL) is applied to the Y electrode of the capacitor Cp through the switch YscH since the capacitor Csc is charged with the voltage (VscH−VscL) (refer to FIG. 13 and Path ① of FIG. 14.)

When the switch Yg is turned off and the switch Yrr is turned on while the switch YscH is turned on, a voltage which gradually rises to the voltage Vset is supplied through the switch Yrr, and hence, a voltage which gradually rises to the voltage (VscH−VscL+Vset) from the voltage (VscH−VscL) is applied to the Y electrode through the high-side switch YscH of the scan IC (refer to FIG. 13 and Path ② of FIG. 14.)

The switch Yrr is turned off and the switch Yg is turned on to reduce the voltage at the Y electrode to the voltage (VscH−VscL) through Path ① of FIG. 14 before a falling reset waveform is applied to the Y electrode.

When the switch Yg and the switch YscH are turned off and the switch Yfr and switch YscL are turned on, a falling ramp waveform which gradually falls to the voltage Vnf from the voltage (VscH−VscL) is applied to the Y electrode through a path formed in the order of the panel capacitor Cp, the switch YscL, the capacitor Csc, the switch Yfr, and the power source Vnf. In this instance, the switch Ynp is maintained at the turned-off state to prevent the current from reversely flowing to the sustain driver.

The voltage at the Y electrode has been reduced to the voltage (VscH−VscL) from the voltage (VscH−VscL+Vset) and the falling ramp waveform has been applied to the Y electrode in the fifth embodiment. However, a falling ramp start voltage can be reduced to the voltage Vs by turning on the switch Ys before a falling ramp waveform is applied.

Also, the power source Vs for applying the sustain voltage can be used for the power source coupled to the switch Yrr in the circuit FIG. 12.

Therefore, a main path switch which is a high-withstanding switch is eliminated by supplying the reset start voltage through the high-side switch of the scan IC. Also, the number of power sources is reduced by controlling the power source coupled to the switch for applying the rising ramp waveform to correspond to the power source of the sustain driver, thereby saving production cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel having a plurality of first electrodes and a plurality of second electrodes, comprising:

gradually increasing a voltage at the plurality of first electrodes to a second voltage from a first voltage during a reset period;

reducing the voltage at the plurality of first electrodes to a third voltage that is lower than the second voltage during the reset period;

gradually decreasing the voltage at the plurality of first electrodes to a fourth voltage from the third voltage during the reset period; and applying a fifth voltage to a first electrode selected from the plurality of first electrodes, and applying a sixth voltage that is higher than the fifth voltage to the first electrodes not selected from the plurality of first electrodes during an address period, wherein the first voltage is equal to a voltage difference between the sixth voltage and the fifth voltage.

2. The method of claim 1, wherein the third voltage corresponds to the first voltage.

3. The method of claim 1, wherein the third voltage corresponds to a sustain voltage applied to the plurality of first electrodes in a sustain period, the sustain voltage being for a sustain discharge.

4. A plasma display panel driver for applying a voltage to panel capacitor formed by a first electrode and a second electrode, the plasma display panel being driven in a reset period, an address period, and a sustain period, comprising:

a first transistor coupled between a first power source for supplying a first voltage and the first electrode;

a capacitor; and a selecting circuit that is coupled to first and second terminals of the capacitor, and that is operable to selectively apply a second voltage and a third voltage that is higher than the second voltage to the first electrode in the address period, wherein a fourth voltage corresponding to a voltage difference between the third voltage and the second voltage is charged to the capacitor, the fourth voltage is applied to the first electrode through a corresponding selecting circuit in the reset period, and the first transistor is turned on to gradually increase the voltage at the first electrode to a fifth voltage from the fourth voltage through the corresponding selecting circuit in the reset period.

5. The plasma display panel driver of claim 4, wherein the selecting circuit comprises:

a second transistor having a first terminal coupled to the first electrode and a second terminal coupled to the first terminal of the capacitor; and a third transistor having a first terminal coupled to the first electrode and a second terminal coupled to the second terminal of the capacitor.

6. The plasma display panel driver of claim 5, wherein when the first transistor is turned on, the second transistor is turned on to gradually increase the voltage at the first electrode to the fifth voltage.

7. The plasma display panel driver of claim 4, wherein the first transistor is turned off to reduce the voltage at the first electrode to the second voltage after the voltage at the first electrode is increased to the fifth voltage.

8. The plasma display panel driver of claim 6, wherein the first transistor is turned off to reduce the voltage at the first electrode to the second voltage after the voltage at the first electrode is increased to the fifth voltage.

9. The plasma display panel driver of claim 5, further comprising a fourth transistor coupled between a second power source for supplying a sixth voltage and the first electrode, and fifth transistor coupled between a third power source for supplying a seventh voltage that is lower than the sixth voltage and the first electrode, wherein during the sustain period, the fourth transistor and the fifth transistor are alternately turn on.

10. The plasma display panel driver of claim 6, further comprising a fourth transistor coupled between a second power source for supplying a sixth voltage and the first electrode, and a fifth transistor coupled between a third power source for supplying a seventh voltage that is lower than the sixth voltage and the first electrode, wherein during the sustain period, the fourth transistor and the fifth transistor is alternately turned on.

11. The plasma display panel driver of claim 9, wherein the first transistor and the second transistor are turned off and the third transistor and a sixth transistor coupled between the third power source and the first electrode are turned on to reduce the voltage at the first electrode to the fourth voltage after the voltage at the first electrode is increased to the fifth voltage.

12. The plasma display panel driver of claim 10, wherein the first transistor and the second transistor are turned off and the third transistor and a sixth transistor coupled between the third power source and the first electrode are turned on to reduce the voltage at the first electrode to the fourth voltage after the voltage at the first electrode is increased to the fifth voltage.

* * * * *